US006997855B2

(12) United States Patent
Choy

(10) Patent No.: US 6,997,855 B2
(45) Date of Patent: Feb. 14, 2006

(54) AUTOMATIC SAFETY SHUT-OFF SWITCH FOR EXERCISE EQUIPMENT

(75) Inventor: Rick Choy, Santa Ana, CA (US)

(73) Assignee: Unisen, Inc., Irvine, CA (US)

( * ) Notice: Subject to any disclaimer, the term of this patent is extended or adjusted under 35 U.S.C. 154(b) by 337 days.

(21) Appl. No.: 10/420,990

(22) Filed: Apr. 22, 2003

(65) Prior Publication Data

US 2005/0075219 A1 Apr. 7, 2005

Related U.S. Application Data

(62) Division of application No. 09/444,276, filed on Nov. 19, 1999, now Pat. No. 6,575,878.

(60) Provisional application No. 60/109,083, filed on Nov. 19, 1998.

(51) Int. Cl.
*A63B 22/02* (2006.01)

(52) U.S. Cl. ..... 482/54; 482/51

(58) Field of Classification Search ..... 482/51, 482/54

See application file for complete search history.

(56) References Cited

U.S. PATENT DOCUMENTS

| | | | | |
|---|---|---|---|---|
| 4,168,495 | A | | 9/1979 | Sweeney |
| 4,312,033 | A | | 1/1982 | Sweeney et al. |
| 4,353,019 | A | | 10/1982 | Sweeney, Jr. |
| 4,708,337 | A | | 11/1987 | Shyu |
| 4,749,181 | A | | 6/1988 | Pittaway et al. |
| 5,314,391 | A | | 5/1994 | Potash et al. |
| 5,368,532 | A | | 11/1994 | Farnet |
| 5,462,504 | A | | 10/1995 | Trulaske et al. |
| 5,545,112 | A | * | 8/1996 | Densmore et al. ..... 482/54 |
| 5,690,587 | A | | 11/1997 | Gruenangerl |
| 5,800,314 | A | | 9/1998 | Sakakibara et al. |
| 5,820,525 | A | | 10/1998 | Riley |
| 5,856,736 | A | * | 1/1999 | Rotunda et al. ..... 318/802 |
| 5,944,635 | A | | 8/1999 | Butler |

* cited by examiner

*Primary Examiner*—Glenn E. Richman
(74) *Attorney, Agent, or Firm*—Knobbe, Martens, Olson & Bear, LLP

(57) ABSTRACT

The present invention relates to a safety off switch for a treadmill exercise device. If the treadmill exercise device running belt is still rotating even after user has left the treadmill exercise device, then, after a programmed time duration, the treadmill exercise device automatically turns off the running belt and/or completely powers itself down.

20 Claims, 3 Drawing Sheets

AUTOMATIC SAFETY SHUT-OFF SWITCH FOR EXERCISE EQUIPMENT

RELATED APPLICATIONS

This application is a division of U.S. patent application Ser. No. 09/444,276, which was filed on Nov. 19, 1999 now U.S. Pat. No. 6,575,878 and which claimed the priority benefit under 35 U.S.C. § 119(e) of U.S. Provisional Patent Application No. 60/109,083, which was filed on Nov. 19, 1998. Each of these prior applications is hereby incorporated by reference in its entirety.

FIELD OF THE INVENTION

This invention relates to the field of exercise equipment, specifically a motorized treadmill exercise device with an automatic safety shut-off feature.

BACKGROUND OF THE INVENTION

Treadmill exercise devices are an integral part of the habitual, aerobic workouts of a culture focused on health and fitness. In the wake of the popularity of treadmill exercise devices, however, certain concerns arise as to the safe and proper use of treadmill exercise devices. In this regard, it is particularly desirable to prevent a treadmill exercise device from being inadvertently left operating after a user has left the device. This is desirable to conserve energy and also to prevent possible risk of someone getting injured by the moving parts of a treadmill exercise device left running.

A treadmill exercise device that has been left running by a user wastes energy. Especially in a home setting if the user is called away from the treadmill exercise device and forgets that the treadmill exercise device is running, the treadmill exercise device can consume energy for extended durations. In a gymnasium or fitness center, a plurality of treadmill exercise devices if left running when not in use would consume substantial energy.

SUMMARY OF THE INVENTION

What is needed is a system and method for automatically powering down the treadmill exercise device when the user has left the treadmill. Accordingly, safety for future users would be enhanced if the treadmill exercise device had the capability of sensing when the previous user has left the treadmill exercise device so that the treadmill exercise device can subsequently, automatically power itself down for future users.

The present invention provides a treadmill comprising a motor and a control panel including control circuitry. The control panel is adapted to monitor and control the motor. The circuitry is adapted to automatically power down the control panel and the motor when the circuitry has sensed a threshold change in an electrical perturbation from the motor during a time duration.

The present invention also provides a treadmill exercise device comprising means for determining when the treadmill exercise device is not being used and means responsive thereto for automatically powering down the treadmill exercise device.

The present invention also provides an exercise device comprising a motor and current detection circuitry coupled to the motor. The circuitry is adapted to sense when no one is using the exercise device based upon changes with respect to time in the current supplied to the motor.

In one embodiment, the current detection circuitry comprises a current sensor for detecting changes in current with respect to time, an amplifier coupled to the current sensor, a filter coupled to the amplifier, and an integrator coupled to the filter.

In other advantageous embodiments of the exercise device, the filter is a low pass filter or a bandpass filter. Furthermore, the filter may be digital or analog. In still other embodiments, the amplifier transforms and amplifies current signals into voltage signals.

In another embodiment, the exercise device further comprises an analog-to-digital converter coupled to the integrator. In yet another embodiment, the exercise device further comprises a threshold detector coupled to the integrator and a timeout circuit coupled to the threshold detector. Optionally, the timeout circuit may comprise a resetable programmable counter.

The present invention, in another embodiment, provides a method for automatically switching off a rotating running belt in a treadmill exercise device when no one is using it, comprising the steps of sensing a threshold change in electrical perturbations from a motor in the treadmill exercise device during a first time duration and automatically powering down the treadmill exercise device after a second time duration if electrical perturbations are not detected.

The present invention also provides, in another embodiment, a method for automatically powering down an exercise device when no one is using the exercise device, comprising the step of detecting changes with respect to time in current supplied to a motor. In another embodiment, the step of detecting changes comprises the step of inducing a current signal in a current detection circuit. In yet another embodiment, in addition to the step of the previous embodiment, the method further comprises the steps of amplifying the current signal, transforming the current signal into a voltage signal, filtering the voltage signal, and integrating the voltage signal with respect to time.

Other advantageous embodiments for automatically powering down the exercise device when no one is using the exercise device include the step of filtering by passing low frequencies. Another embodiment includes the step of filtering by filtering low frequencies and filtering high frequencies.

In addition, another advantageous embodiment comprises the steps of comparing the integrated voltage signal value with a threshold value, enabling a timeout circuit, and automatically powering down the exercise device. Furthermore, in yet another embodiment, the step of enabling comprises the step of resetting the timeout circuit. Moreover, in another embodiment, the step of enabling comprises the step of enabling and resetting a resetable counter programmed for a time duration.

The present invention also provides a method for automatically detecting changes in current with respect to time comprising the steps of inducing a current signal in a current sensor, amplifying the current signal, transforming the current signal into a voltage signal, filtering the voltage signal, and integrating the voltage signal.

BRIEF DESCRIPTION OF THE DRAWINGS

The present invention is described in more detail below in connection with the attached drawing figures in which.

DETAILED DESCRIPTION OF THE PREFERRED EMBODIMENT

One preferred embodiment of the present invention provides circuitry for sensing when a user has left the treadmill exercise device by detecting the absence of perturbations in the current supplied to the motor. The circuitry automatically powers down the treadmill exercise device when no user motion is sensed.

Figure 1:
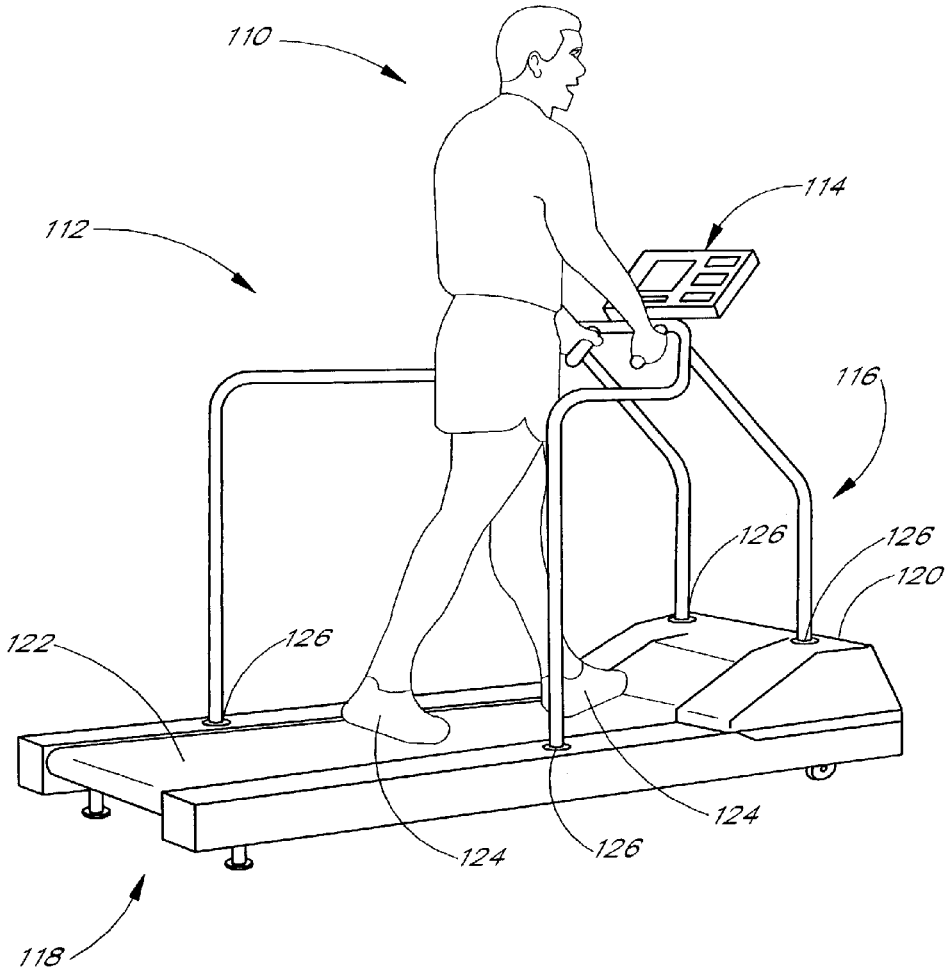
FIG. 1 illustrates an user using a treadmill exercise device.

FIG. 1 illustrates a user 110 walking, jogging or running on a treadmill exercise device 112 in accordance with one embodiment of the present invention. The treadmill exercise device 112 comprises a control panel 114, a support structure 116, and a base 118 with support structure vias 126. The support structure 116 is mounted to the top of the base 118 at the support structure vias 126. The control panel 114 is mounted on top of the support structure 116. The user 110 is supported on top on the base 118. The user 110 may also grip part of the support structure 116 for added stability.

The base 118 further comprises a housing 120, a running belt 122, a running deck (not shown), and a motor (not shown). The housing 120 houses the motor which is coupled to the running belt 122. The running deck is positioned on top of the housing 120 and supports the user 110 and the running belt 122. The running belt 122 is positioned on top of and below the running deck and is supported by rollers or other means (not shown).

The control panel 114 preferably includes circuitry (not shown) adapted to monitor and control the motor. Of course, the exact location of the circuitry is not particularly important and all or part of the circuitry may be located elsewhere in the treadmill exercise device 112. The circuitry is in electrical communication with the motor such as through the support structure 116. In one embodiment, the support structure 116 comprises hollow tubing adapted to provide support to the user 110 and also to house electrical wiring. The electrical wiring provides electrical communication between the circuitry of the control panel 114 and the motor in the base 118.

In operation, the user 110 approaches the treadmill exercise device 112 and steps onto the running belt 122, supported by the running deck, the user being at an optimal distance, as determined by the user 110, from the control panel 114. The user 110 then programs the control panel 114 by entering information such as the weight of the user 110 and the speed at which the user 110 wishes to walk, jog or run. The control panel 114 processes the information and uses control circuitry to start the motor. The motor causes the running belt 122 to rotate around the running deck and through the housing 120.

As the running belt 122 rotates, the user 110 takes strides at a rate commensurate with the speed of the running belt 122. During each stride, a foot 124 of the user 110 creates an impact on the running belt 122 which is a function of the weight of the user 110. Accordingly, the running belt 122 is forced into greater contact with the running deck resulting in an increased frictional force which appears at the motor in the form of a torque disturbance. The frictional force is a function of the weight of the user 110 and the effective coefficient of friction between the running belt 122 and the running deck. The torque disturbance impresses an electrical perturbation in the form of a back electromotive force in the motor which is sensed by the circuitry in the control panel 114 which is in electrical communication with the motor.

Thus, an approximately periodic rate of foot impacts by the user 100 who may be walking, jogging or running, creates an electrical signal reflecting the approximately periodic electrical perturbations. This signal is monitored by the circuitry in the control panel 114. If the user 110 falls or leaves the running belt 122 while the running belt 122 is still rotating, the circuitry will no longer sense the electrical perturbations caused by the user 110.

In one embodiment, if the amplitude of the signal reflecting the electrical perturbation stays below a threshold value during a first period of time, then the circuitry will, after a second period of time, automatically power down the motor and/or the control panel 114. In such an embodiment, a threshold value must be set or determined in which the circuit distinguishes between the electrical signal reflecting the electrical perturbation caused by a user and the electrical signal reflecting electrical noise. One alternative is to set the threshold value equal to a multiple of, e.g. two, three or four times, the average electrical noise signal. Another alternative is to set the threshold value as a function of the weight of the user 110. One such alternative might set the threshold value to, for example, fifty percent of the peak amplitude of the signal reflecting the electrical perturbation created by a user 110 of the programmed or default weight.

In such an embodiment, the first period of time must be either determined or arbitrarily set. One alternative for determining the first period of time is to make the period a function of the programmed or actual speed of the running belt 122. In such an alternative, a slower moving running belt 122 would need a longer first period of time than a faster moving running belt 122. Likewise, the first period of time can be a multiple of the period of time required for the running belt 122 to make one full rotation. In the aforementioned embodiment, the second period of time can be set by the manufacturer.

In another embodiment, the signal reflecting the electrical perturbation is processed by the circuitry to produce a value which is compared to another threshold value. If the processed signal values stay below a threshold value during a first period of time, then the circuitry will, after a second period of time, automatically power down the motor and the control panel 114. In this embodiment, the first and second periods of time can be determined as previously discussed for other embodiments and alternatives.

In one alternative, the signal reflecting the electrical perturbation is integrated over a time duration to produce the value. The time duration over which the signal is integrated can be set by the manufacturer as a default time duration or can be a function of the actual or programmed speed of the running belt 122. Alternatively, the time duration can be a function of the average of the last, for example, three time intervals between electrical perturbations or foot impacts. The time duration can be variable or constant, but should preferably be at least long enough such that the time duration encompasses the time interval between foot impacts when the user 110 has slowed from a run down, in which short time durations are needed, to a slow walk, in which long time durations are needed.

Figure 2:
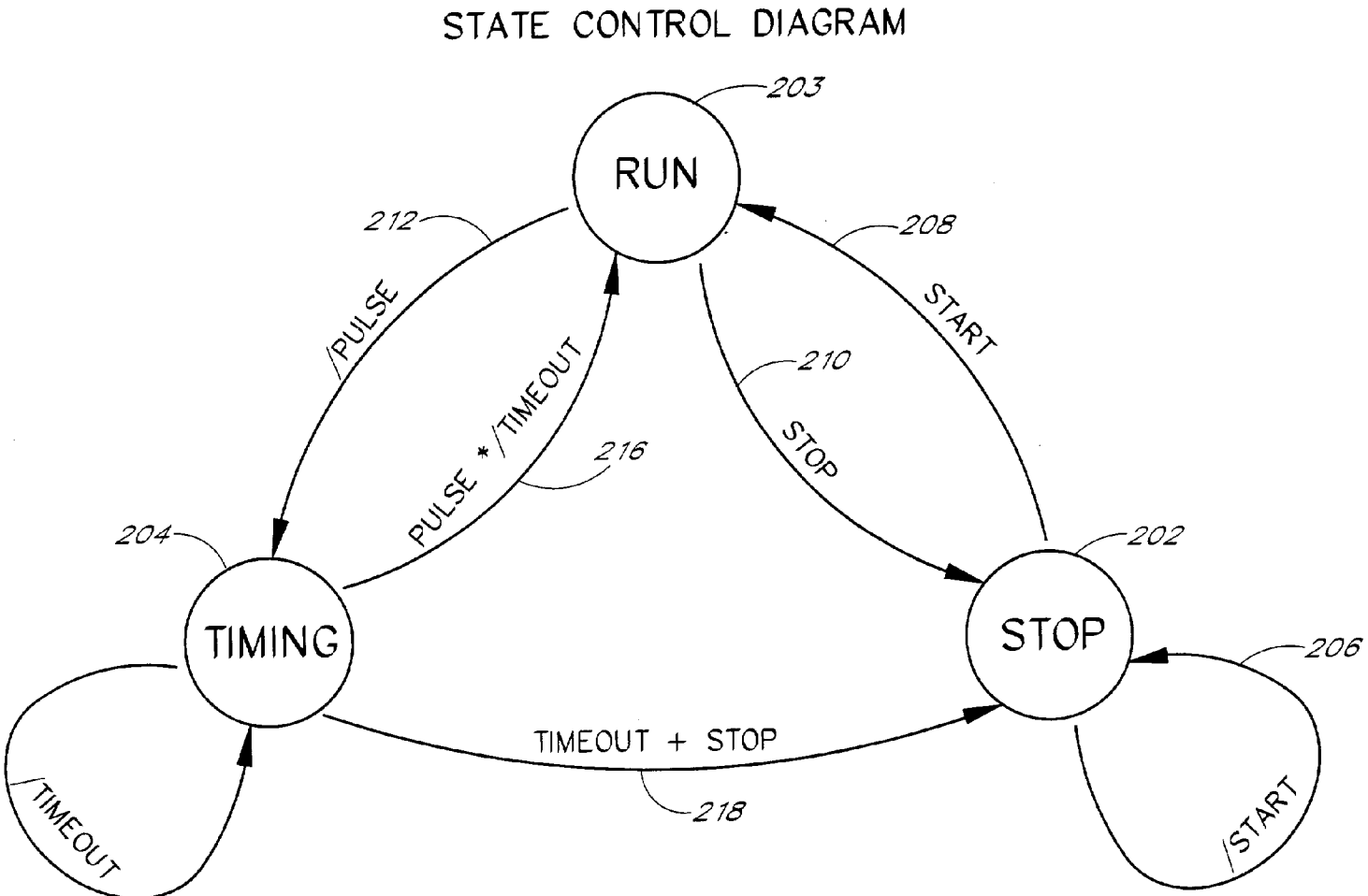
FIG. 2 illustrates a state diagram for the treadmill exercise device.

FIG. 2 is a state diagram illustrating the operation of the treadmill exercise device 112 in accordance with one embodiment of the present invention. The three states 202–204 illustrated by FIG. 2 are STOP, RUN and TIMING, respectively. The STOP state 202 indicates that the running belt is not moving. As indicated by "/Start" 206, until a start process is completed, the treadmill exercise device remains in the STOP state 202. In one embodiment, the start process includes programming the control panel 114 through a user interface to control and manipulate the motor in the base 120 in order to get the running belt 122 moving. Once the start process is completed 208, the treadmill exercise device 112 moves into the next state, the RUN state 203.

In the RUN state 203, the running belt 122 is moving across the running deck. The treadmill exercise device 112 can move from a RUN state 203 back to a STOP state 202 if a stop process 210 is completed. In one embodiment, the stop process includes programming the control panel 114 by the user 110 through a user interface. The treadmill exercise device 110 moves from the RUN state 203 into the TIMING state 204 once the pulse process is in progress 212. In one embodiment, the pulse process includes detecting a certain number of pulses representing the electrical perturbations within a first period of time. In another embodiment, the pulse process includes processing electrical signals from the motor and comparing the processed signal values to one or more threshold values over a first period of time.

In the TIMING state 204, a timer counts out a preset time interval, shown as a timeout process in FIG. 2. While the treadmill exercise device is in the timeout process 214, the treadmill exercise device 112 remains in the TIMING state 204. Should the pulse process be completed during the timeout process 216, then the treadmill exercise device 112 would return back to the RUN state 203. In one embodiment, the successful completion of the pulse process before the end of the timeout process 216 indicates that the user 110 is still walking, jogging or running. However, should the timeout process be completed before the completion of the pulse process 218, then the treadmill exercise device 112 would move into the STOP state 202. In one embodiment, the completion of the timeout process 218 before the completion of the pulse process indicates that the user 110 has left the treadmill exercise device 112. A transition from the TIMING state 204 to the STOP state 203 may also be achieved if the stop process 218 is completed.

Figure 3:
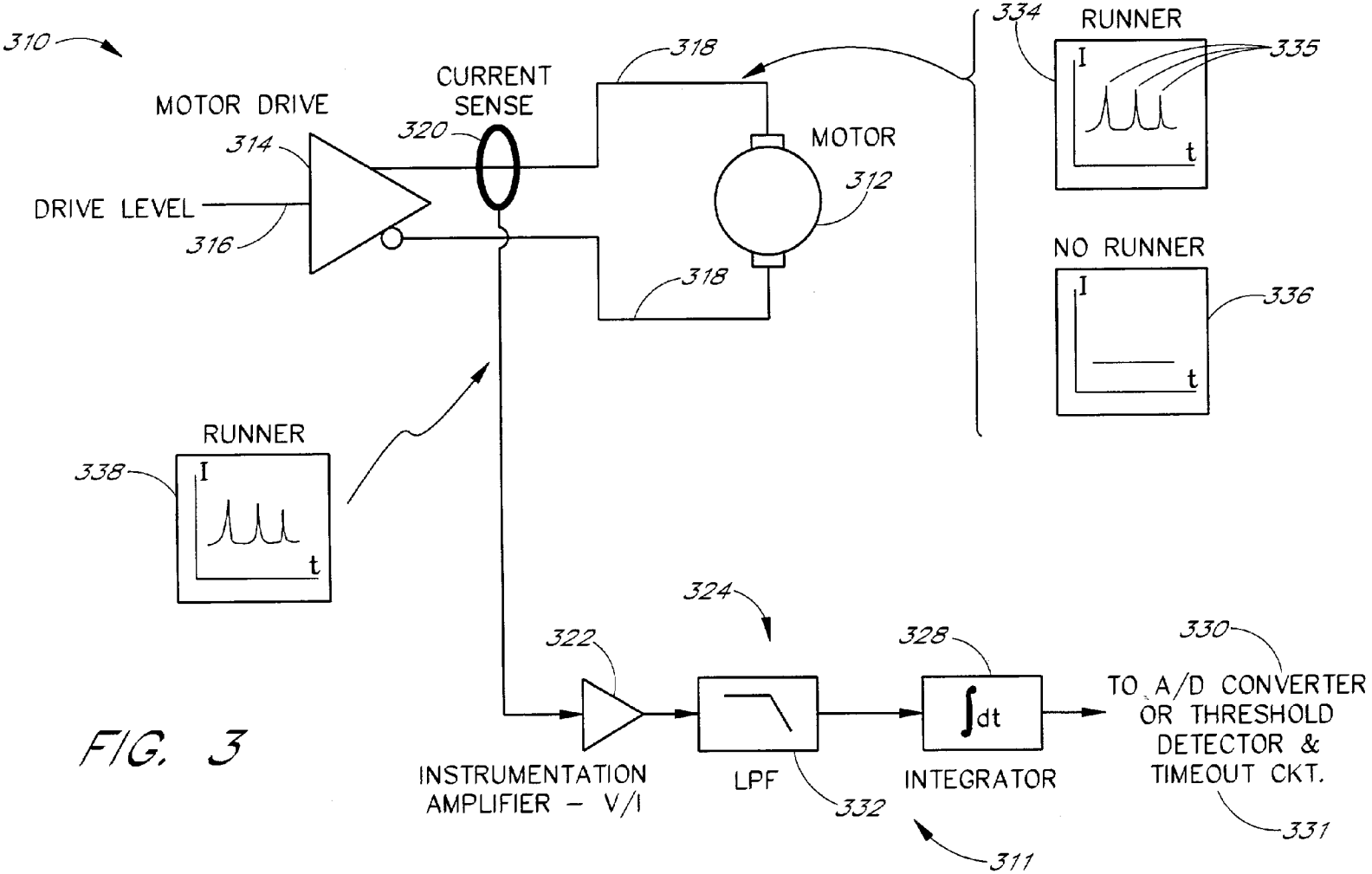
FIG. 3 illustrates a block diagram for a motor control system and a current detection system.

FIG. 3 illustrates a simplified, schematic block diagram of a motor control system 310 and a current detection system 311 in accordance with one embodiment of the present invention. The current detection system 311 is coupled to the motor control system 310.

The motor control system 310 comprises a motor drive 314, a drive level line 316, and a plurality of connection lines 318. The drive level line 316 is in electrical communication with an input to the motor drive 314. In one embodiment, the drive level input line 316 is in electrical communication with circuitry located in the control panel 114. The motor drive 314 is in electrical communication with the motor 312 through the connection lines 318.

The current detection system 311 comprises a current sensor 320, an amplifier 322, a filter 324 and an integrator 328. The current sensor 320 is coupled to an input of the amplifier 322. In one embodiment, the current sensor 320 comprises a ring or a coil. Furthermore, the current sensor 320 is positioned around and coupled to the power connection line 318 of the motor control system 310. The output of the amplifier 322 is coupled to an input of the filter 324. In one embodiment, the filter 324 is a low pass filter 332 which can be digital or analog. The output of the filter 324 is coupled to an input of the integrator 328. The output of the integrator 328 is coupled to an analog-to-digital converter or to a threshold detector and timeout circuit 330.

The general use and operation of the motor control system 310 and the current detection system 311 will now be described with reference to FIG. 3. The user 110 initially approaches the treadmill exercise device 112 and steps onto the running belt 122 in front of the control panel 114. The user 110 then programs the control panel 114 by entering information such as the weight of the user 110 and the speed at which the user 110 wishes to walk, jog or run. The circuitry inside the control panel 114 processes the information and raises the drive level line 316 to a calibrated current level corresponding to the amount of current that will be required by the motor 312. The motor drive 314 amplifies the current from the drive level line 316 and provides an amplified current to the connection lines 318 which ultimately is received by the motor 312. The motor 312 uses the amplified current and begins to rotate. This rotational energy is translated and reflected through gear and rollers (not shown) which ultimately rotate the running belt 122. Thus, the magnitude of the current placed on the drive level line 316 by the circuitry of the control panel 114 controls the rotational speed of the running belt 122.

When the user 110 is walking, jogging or running on the treadmill exercise device 112, each foot impact on the running belt 122 of the treadmill exercise device 112 causes an increase in the frictional force that is a function of the weight of the user 110 and the effective coefficient of friction between the running deck and the running belt 122. The frictional force is applied to the treadmill exercise device 112 during each foot impact and results in a back electromotive force at the motor 312. Accordingly, the motor 312 must work harder and, thus, consume more power to keep the running belt 122 moving at the same rate. The greater power consumption of the motor 312 corresponds to the increased current required by the motor 312 which is provided through the motor drive 314.

During each foot impact by the user 110, the current requirements of the motor 312 increase which may be represented as a pulse 335 in a plot 334 of current verses time. When foot impacts are absent from the running belt 122, then a plot 336 of the current requirements of the motor does not have pulses 335. Thus, the pulses 335 are superimposed on the plot 336 to create the plot 334 of the overall current requirements of the motor 312 with respect to time.

The pulses 335 are changes in current with respect to time and cause changes in the magnetic flux with respect to time around the connection lines 318 carrying the current pulses. These changes in magnetic flux with respect to time are detected in the current sensor 320 creating an induced electromotive force and accompanying induced current signal in the current detection system 311. Accordingly, the current pulses in the motor control system 310 induce current pulses which form a current signal in the current detection system 311 as illustrated in plot 338.

The current signal propagates to the amplifier 322. In one embodiment, the amplifier 322 is a transresistance amplifier which means that the input current signal is amplified and transformed into an output voltage signal. The output voltage signal, in one embodiment, propagates through a low pass filter 332 which may be digital or analog. The low pass filter 332 removes unwanted noise. The filter 324 is low pass since the range of foot-impact frequencies occurs at relatively low frequencies. The cutoff frequency of the low pass filter 332 should be determined so that the foot-impact frequency range passes through the filter 332, but high frequency noise is removed from the signal. Another embodiment uses a bandpass filter to remove high and low frequency noise components without significant attenuation in the frequency range at which foot impacts occur.

The filtered voltage signal is then integrated by the integrator 328. The integrator periodically integrates the filtered voltage signal over a predetermined time duration. This time duration may be set by the manufacturer as a default time duration or can be a function of the actual or programmed speed of the running belt 122. Other alternatives for determining the time duration were discussed above. An output signal from the integrator 328 represents an integration of the filtered voltage signal over the previous period of time in length equal to the time duration. Thus, the more foot impacts in a given time duration by the same user, then the larger the output signal from the integrator 328.

The signal can then be digitized by the analog-to-digital converter 330 as in one embodiment or sent directly to the threshold detector and timeout circuit 331 as in another embodiment. The threshold detector determines whether the output signal from the integrator 328 has dropped below a threshold value at which point the timeout circuit such as a resetable programmable counter is activated. The threshold value should preferably be set such that the threshold detector can distinguish between values from integrating signals containing noise and values from integrating signals containing pulses. In one alternative, the threshold value may factor in the weight or some other characteristic of the user 110 since a heavier user 110 would create greater pulses and thus larger output signals from the integrator 328. In another alternative, the threshold value may also be a multiple of the value of the output signal from the integrator 328 when no foot impacts fall on the rotating running belt 122.

After the user 110 has stepped off the running belt 122 for a period of time, the output signal from the integrator 328 will drop below the threshold value. In one embodiment, the threshold detector then resets and enables the resetable programmable counter which then counts toward a programmed number representing a programmed time duration. If during the preset time duration of the counter, the output signal from the integrator 328 rises above the threshold value, as is the case when foot impacts from the user 112 commence again, then the threshold detector disables the resetable programmable counter. Accordingly, if the output signal from the integrator 328 again drops below the threshold value, the threshold detector would reset and enable the counter. If the counter reaches its programmed number representing the end of the programmed time duration, then the treadmill exercise device 112 automatically powers itself down.

Although the foregoing invention has been described in terms of certain preferred embodiments, other embodiments will become apparent to those of ordinary skill in the art in view of the disclosure herein. Accordingly, the present invention is not intended to be limited by the recitation of preferred embodiments, but is intended to be defined solely by reference to the appended claims.

What is claimed is:

1. A method for automatically powering down an exercise device when no one is using said exercise device, the method comprising detecting changes with respect to time in current supplied to a motor which changes result from foot impacts upon a running belt of said exercise device, determining if a user is running on the exercise device based on the changes with respect to time of the current supplied to the motor, and stopping the running belt if it is determined that no one is running on the exercise device.

2. The method in claim 1, wherein detecting changes comprises inducing a current signal in a current detection circuit.

3. A method for automatically powering down an exercise device when no one is using said exercise device, the method comprising detecting changes with respect to time in current supplied to a motor which changes result from foot impacts upon a running belt of said exercise device, wherein detecting changes comprises inducing a current signal in a current detection circuit, and further comprising amplifying said current signal, transforming said current signal into a voltage signal, filtering said voltage signal, and integrating said voltage signal with respect to time.

4. The method of claim 3, wherein filtering comprises passing low frequencies.

5. The method of claim 3, wherein filtering comprises filtering low frequencies and filtering high frequencies.

6. The method of claim 3, further comprising comparing said integrated voltage signal value with a threshold value, enabling a timeout circuit, and automatically powering down said exercise device.

7. The method of claim 6, wherein enabling comprises resetting said timeout circuit.

8. The method of claim 6, wherein enabling comprises both enabling and resetting a counter programmed for a time duration.

9. A method for automatically switching off a rotating running belt in a treadmill exercise device when no one is on said rotating running belt, the method comprising sensing for electrical perturbations from said motor in said treadmill exercise device during a first time duration, and automatically powering down said rotating running belt exercise device after a second time duration if a threshold number or magnitude of electrical perturbations as not sensed.

10. The method of claim 9 further comprising powering down a control panel after said second time duration if said threshold number or magnitude of electrical perturbations is not sensed.

11. A method of automatically stopping a rotating running belt in a treadmill exercise device when no one is on said rotating running belt, the method comprising sensing a level of electrical perturbation from a motor that drives said running belt sensing a change in said level of electrical perturbation from said motor over a time period, and disabling said motor when said sensed change in said level of electrical perturbation indicates that no one is on said rotating belt.

12. The method of claim 11, wherein disabling said motor comprising waiting a preset time duration during which substantial electrical perturbations are not detected.

13. The method of claim 11, wherein disabling said motor comprising waiting a preset time duration during which electrical perturbations exceeding a predetermined threshold are not detected.

14. The method of claim 13, wherein said predetermined threshold is set to distinguish between electrical perturbation caused by a user and electrical signals caused by electrical noise.

15. The method of claim 13, wherein said predetermined threshold is set equal to about a multiple of an average electrical noise signal.

16. The method of claim 13, wherein said predetermined threshold is set as a function of a weight of a user.

17. The method of claim 16, wherein said predetermined threshold is set to fifty percent of a peak amplitude of a signal reflecting said electrical perturbation created by a user of said weight.

18. The method of claim 11, wherein said time period during which said change in said level of electrical perturbation from said motor is sensed is set as a function of a speed of said running belt.

19. The method of claim 18, wherein said speed is an actual speed of said running belt.

20. The method of claim 18, wherein said speed is a programmed speed of said running belt.

* * * * *